United States Patent [19]

Bridgeman

[11] 4,347,828

[45] Sep. 7, 1982

[54] LAUNCHER FOR FLYING DISCS

[76] Inventor: Gerald L. Bridgeman, 421 N. Morrow, Drumright, Okla. 74030

[21] Appl. No.: 130,731

[22] Filed: Mar. 17, 1980

[51] Int. Cl.[3] ..... F41B 3/04; A63H 33/18

[52] U.S. Cl. ..... 124/5; 124/81; 124/36

[58] Field of Search ..... 124/5, 7, 6, 8, 41 R, 124/42, 81, 1, 43; 273/1 B, 129 K; 46/74 R, 82

[56] References Cited

U.S. PATENT DOCUMENTS

| | | | |
|---|---|---|---|
| 1,186,098 | 6/1916 | Horst | 124/5 |
| 1,700,880 | 2/1929 | Camp | 124/5 |
| 3,665,911 | 5/1972 | Altier | 124/88 X |

*Primary Examiner*—Richard C. Pinkham
*Assistant Examiner*—William R. Browne
*Attorney, Agent, or Firm*—Head, Johnson & Stevenson

[57] ABSTRACT

A launcher for flying discs of the type having an integral circumferential rim with an inner edge, the launcher having a rigid handle, an arm pivoted at the outer end of the handle, a basket portion for cradling a flying disc at the end of the arm, and a pin pivoted to the outer end of the arm and dimensioned to engage the inner edge of the rim of a flying disc positioned in the basket portion, the pin serving to apply force to the disc as the arm is swung pivotally outward during a casting motion by the user, the pin pivoting downwardly to allow the disc to freely escape the basket portion at the outer end of the casting stroke.

5 Claims, 4 Drawing Figures

LAUNCHER FOR FLYING DISCS

BACKGROUND OF THE INVENTION

1. Field of the Invention

This device relates to apparatus for launching flying discs. At the present time in the United States and many other areas of the world, flying discs are widely used for games and recreation. Flying discs are made of plastic material and are usually in the form of a round disc of approximately 10" to 12" in diameter. The discs have a closed top surface and a downwardly depending circumferential ridge with an inner edge exposed, the bottom of the disc being open so that the top of the disc is convex and the bottom of the disc is concave. Flying discs are launched by hand, usually by the user placing one or more fingers underneath the disc engaging the underneath surface and the inner rim and with the thumb on top of the disc.

This invention is directed to a device for manual use wherein a greater throwing force and therefore greater distance may be achieved in throwing a flying disc.

2. Description of the Prior Art

Apparatus for throwing small discs for target practice are known. These devices usually include a spring arrangement for cocking an arm relative to a handle portion. The small discs or "clay pigeons" as they are frequently called, are placed in the devices, and the user launches them by a throwing motion. Other target launching devices are known, including those which are mounted on a stationary platform in which spring action serves to launch the disc when a trip is released.

While the prior art generally describes disc-casting or launching devices, it has not taught the concept of an apparatus to cast a large disc of the type commonly utilized for recreation which is made of plastic material. In addition, the known disc casting devices such as those for use in casting clay pigeons, are not concerned with the desirability of imparting the correct rotational motion to the disc as it is cast.

It is therefore an object of this invention to provide a device for launching large discs such as flying discs made of plastic used for recreation.

More particularly, an object of this invention is to provide a launcher for flying discs in which means is provided for imparting rotational motion to the disc as it is launched so that a more predictable flight pattern is achieved.

These general objects as well as other and more specific objects of the invention will be set forth in the following description and claims, taken in conjunction with the attached drawings.

SUMMARY OF THE INVENTION

A launcher for flying discs of the type made of plastic having a solid top and an integral downwardly extending circumferential rim with an inner edge is provided. The launcher includes a rigid handle having means at one end for grasping by the user. At the outer end of the rigid handle is an arm pivotally attached to it so that the arm is free to move through an arc of about 45° to about 180° relative to the handle. When the arm is pivoted relative to the handle, and when it reaches the maximum degree of pivotation, which is about 180° relative to the axis of the handle, it is suddenly stopped. The arm includes a basket portion at the outer end for cradling a flying disc therein. The basket portion includes opposed spaced apart surfaces which loosely receive the flying disc and from which the flying disc easily escapes at the end of the launching motion. At the outer end of the arm is a pivoted pin. In one position the pin extends perpendicular to the planes of the basket and is dimensioned to engage the inner rim of a flying disc. As the arm and basket portion swing outwardly, the flying disc is cast by centrifugal force and flies out of the basket. As it is being cast forward, the pin applies force to retain the flying disc in the basket portion; at the end of the cast, the pin pivots downwardly. In the downward position, the pin permits the flying disc to pass freely outward without restriction. The pin serves two purposes. First, it retains the flying disc in the basket portion during the casting motion. Second, it imparts the proper rotational motion to the disc so that the flight pattern of the disc is improved.

DESCRIPTION OF THE PREFERRED EMBODIMENT

Figure 1:
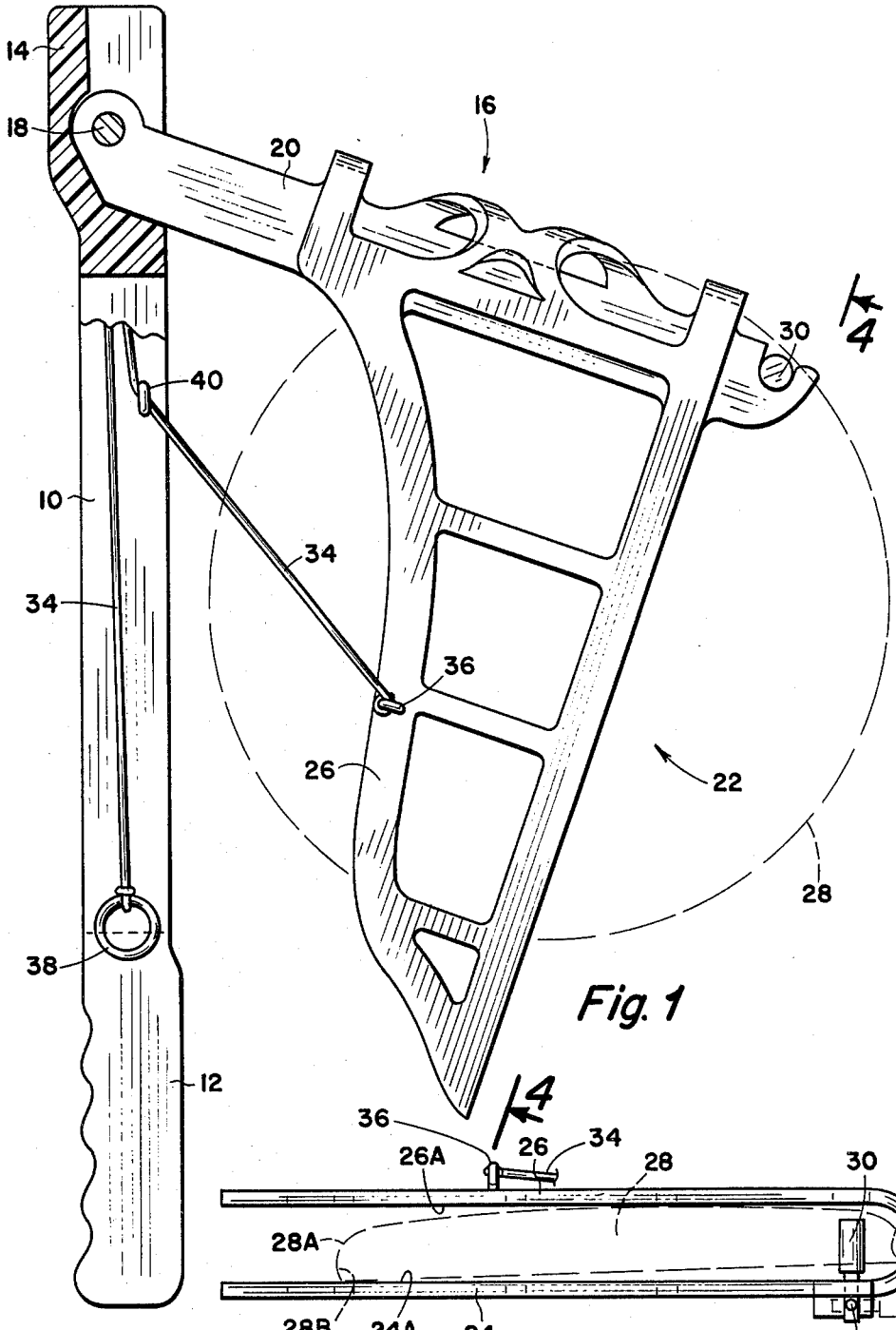
FIG. 1 is a planar view, shown partially in cross-section, of a launcher for flying discs according to this invention, a disc being shown in position in dotted outline and the launcher being shown in the position of the components at the start of a launching motion.

Looking first at FIG. 1, an illustration of one embodiment of the invention is shown. The launcher includes a handle 10. At the inner end of handle 10 is a hand grip 12 by which the user holds the device while launching a flying disc. At the outer end 14 of the handle there is attached an arm portion generally indicated by the numeral 16. The arm is attached to the handle by means of a pivot pin 18 and includes a main arm portion 20. Affixed to the arm portion 20 is an integral basket portion generally indicated by the numeral 22. By comparing FIGS. 1 and 4 it can be seen that the basket portion includes two integral wing portions 24 and 26. Wings 24 and 26 provide inner surfaces 24A and 26A which are planar and parallel to each other and spaced a distance apart slightly greater than the thickness of the flying disc to be launched by the device.

Figure 4:
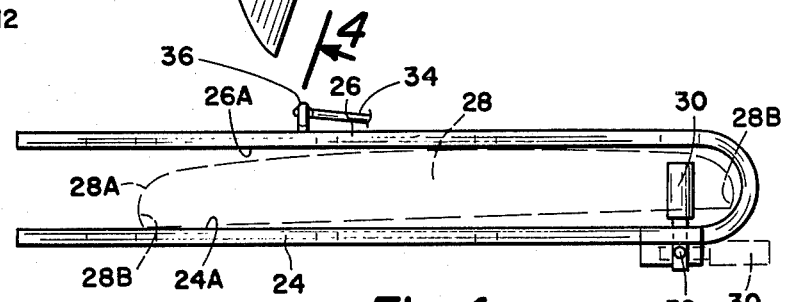
FIG. 4 is an end view of the basket portion of the arm as shown along the line 4—4 of FIG. 1 and showing a flying disc positioned in the basket portion in the position it occupies before and during launch.

FIGS. 1 and 4 show a flying disc 28 in dotted outline positioned in the basket portion 16 as in the relationship of components prior to a launching action. The flying disc is a cylindrical device having a closed top and open bottom with a circumferential rim 28A, the rim having an inner edge 28B.

A pin 30 is pivotally affixed to the arm main portion 20 at the outer end, that is, at the end opposite the end pivotally attached to the handle. The pin 30 is pivoted about an axis 32 (see FIGS. 2 and 3) and is pivoted through an arc of 90°. In the position shown in FIG. 1 and in solid outline in FIG. 4, the pin is in the position it occupies before and during launch, that is, pin 30 extends so that its axis is substantially perpendicular to the inner surfaces 24A and 26A of the cradle wings 24 and 26. In this upwardly extended position it engages the inner edge 28B of the flying disc to hold it in position during launch and to impart proper spinning rotation at the end of the launch. As the flying disc is cast out of the cradle at the end of the forward motion of the arm 16, the pin 30 is pivoted downwardly as a disc moves out of the cradle, as shown in dotted outline in FIG. 4.

In order to enable the operator to more precisely control the launching of a flying disc, a means may be provided so that the operator selects the time of pivotal release of the arm 16 as the handle 10 is swung forwardly. One means of accomplishing this, as illustrated, includes the use of a string 34 having one end attached to the arm such as by means of an eyelet 36 secured to the arm basket portion 22. The other end of the string 34 has a ring 38 affixed to it. By means of eyelets 40 and 42 secured to the handle 10, the ring 34 can be positioned adjacent handle 12 when the arm and basket portion 22 are in the folded position, as shown in FIG. 1.

The user can place his thumb on ring 38 and, as the handle 10 is thrown forwardly during the launch procedure, may control release of the arm and basket portion by releasing engagement with the ring.

OPERATION

Figure 2:
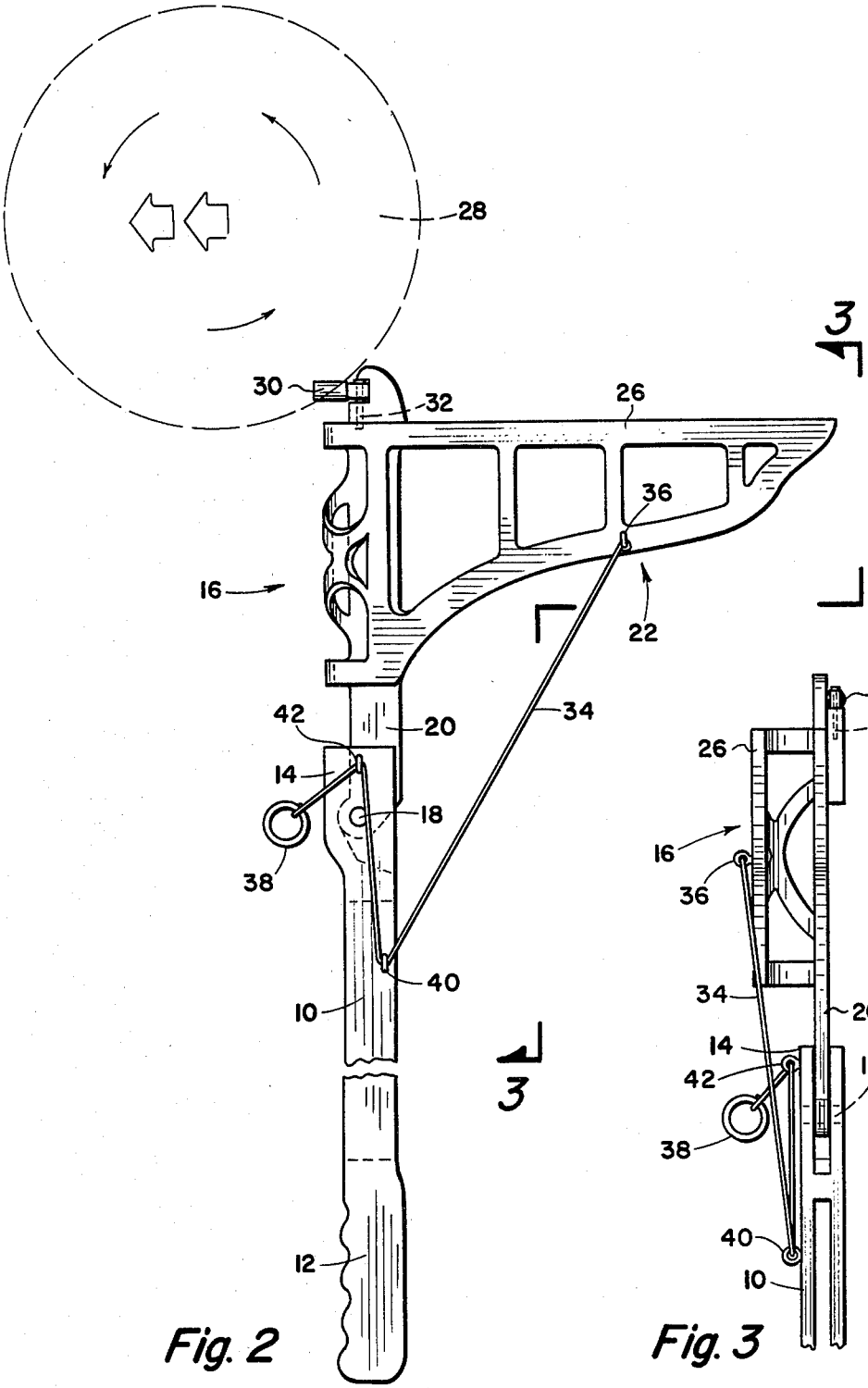
FIG. 2 is a plan view of the launcher showing the relationship of components at the end of the launching motion. The flying disc is shown in dotted outline in the position it takes as it leaves the launcher.
Figure 3:
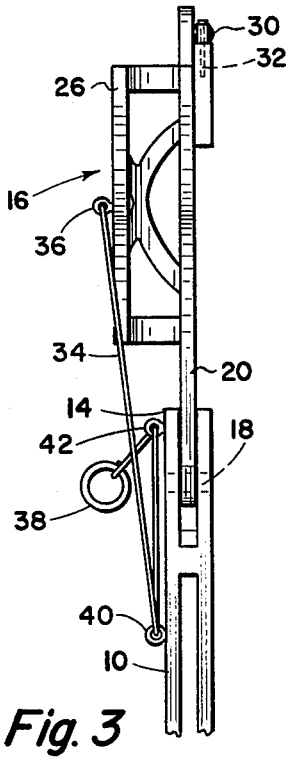
FIG. 3 is a side view as taken along the line 3—3 of FIG. 2, only a portion of the handle being shown.

The flying disc is positioned in cradle 22 between the wing 24 and wing 26 and with pin 30 extending upwardly and with the arm 16 rotated rearwardly towards the handle 10. The user grasps the handle 10 and slings the entire assembly in a side arm motion of the arm like swinging a tennis racket. At the outer end of the swing the user stops the motion of the arm and pivots his wrist, giving a final forward impetus to the rotational movement of the arm. The arm snaps to the maximum forward position as shown in FIG. 2. This applies a centrifugal force to the flying disc 28 and as the arm 16 suddenly moves to its maximum forward position and stops, the disc motion continues and the disc travels freely outwardly past cradle 22. This outward motion pivots the pin 30 downwardly to the position shown in FIGS. 2 and 3. The pin thereby retains the flying disc in position in the cradle until proper release point, and at that time, and by such action, rotational motion is applied to the disc as shown by the arrows in the FIG. 2. This rotational energy applied to the disc ensures that it will travel further and in a more predictable flight pattern than if attempt was made to launch the disc without imparting rotational motion.

As previously described, the operator utilizes string 34 by placing his thumb on ring 38 when the arm is pivoted to the rearward position as shown in FIG. 1, that is, in the ready-to-launch position. As the handle 10 is swung forwardly the operator can control the release of the arm by timing release of thumb pressure on ring 38. In this manner the operator can more precisely control casting of a flying disc utilizing the device. Further, by pulling on ring 38 the arm is automatically moved back into the ready-to-launch position for receiving a flying disc.

It can be seen that the device may be constructed in a variety of other arrangements, and the embodiment illustrated herein is for purposes of exemplification. It is understood that the invention is not limited to the embodiment illustrated but is to be limited only by the scope of the attached claim or claims, including the full range of equivalency to which each element thereof is entitled.

What is claimed is:

1. A launcher for flying discs of the type having an integral circumferential rim, the rim having an inner circumferential surface, comprising:

a rigid handle having means at one end for manual engagement by the user;

an arm pivotally attached at its inner end to the other end of the handle, the arm having a basket portion for cradling a flying disc therein; and a pin pivoted to said arm and arranged to engage the inner circumferential surface of the rim of a flying disc positioned in said arm basket portion prior to launching the flying disc, said pin being pivotal between a first upright position wherein the axis thereof is substantially perpendicular said basket portion surfaces in which position the pin is adapted to engage the inner circumferential surface of a flying disc rim, and a second, outward position wherein the axis of the pin is substantially parallel to said basket portion surfaces, the pin serving to retain a flying disc in position in the basket during the first portion of a launch, the pin pivoting as a flying disc is launched by the force of a flying disc as it is flung outwardly from said arm basket portion, and said basket portion including means providing parallel surfaces spaced apart slightly greater than the thickness of the flying disc for which the launcher is dimensioned, the surfaces being in planes parallel to the axis of said handle and arm.

2. A launcher for flying discs according to claim 1 wherein the pivotal connection of said arm and said handle includes stop means whereby said arm is limited in rotation to an arc of about 45° to about 180° relative to the axis of said handle.

3. A launcher for flying discs according to claim 1 including means operable by the user to control the pivotal movement of said arm relative to said handle.

4. A launcher for flying discs according to claim 1 wherein said means operable by the user to control the pivotal movement of said arm includes:

a cord having one end affixed to said arm, the other end being positionable adjacent to the end of said handle engaged by the user.

5. A launcher for flying discs according to claim 1 wherein said arm basket portion includes means providing parallel spaced apart surfaces, the surfaces being in planes parallel the axii of said handle and arm, a flying disc being positionable between said surfaces prior to and during launch.

* * * * *